US005301942A

United States Patent [19]

Lacrosse

[11] Patent Number: 5,301,942

[45] Date of Patent: Apr. 12, 1994

[54] COIN DROP AMUSEMENT GAME

[76] Inventor: William R. Lacrosse, 115 Colridge Ct., Alpharetta, Ga. 30202

[21] Appl. No.: 54,305

[22] Filed: Apr. 30, 1993

[51] Int. Cl.[5] ..... A63F 7/02

[52] U.S. Cl. ..... 273/138 R; 273/457

[58] Field of Search ..... 273/138 R, 457, 121 B, 273/120 R, 145 C, 145 B

[56] References Cited

U.S. PATENT DOCUMENTS

| | | | |
|---|---|---|---|
| 503,942 | 8/1893 | Buchanan | 273/138 R |
| 508,922 | 11/1893 | Davis | 273/138 R |
| 524,475 | 8/1894 | Wheeland | 273/138 R |
| 641,861 | 1/1900 | Huestis | 273/138 R |
| 1,630,098 | 5/1927 | Smith | 273/138 R |
| 1,947,772 | 6/1934 | Harris | 273/138 R |

*Primary Examiner*—Benjamin H. Layno
*Attorney, Agent, or Firm*—Aquilino & Welsh

[57] ABSTRACT

An amusement game of skill which can be used as a fund raiser for various purposes, such as charity, while also serving as an advertising media. The game is in the form of a free-standing display and includes a receptacle having a mouth at one end, a base at its other end and a central body portion therebetween. Disposed within the central body is a plurality of pins forming a maze through which a coin travels and a coin rest pedestal upon which a coin must rest in order to win the game. The plurality of pins can be formed on replaceable cards in numerous maze patterns, thereby creating many games in a single device. The base is such that it supports the game in an upright manner while also functioning as a money collection box. The receptacle is formed so as to be watertight, thereby allowing the game to be filled with a fluid in order to alter a dropped coin's path of travel.

20 Claims, 3 Drawing Sheets

FIG. 7
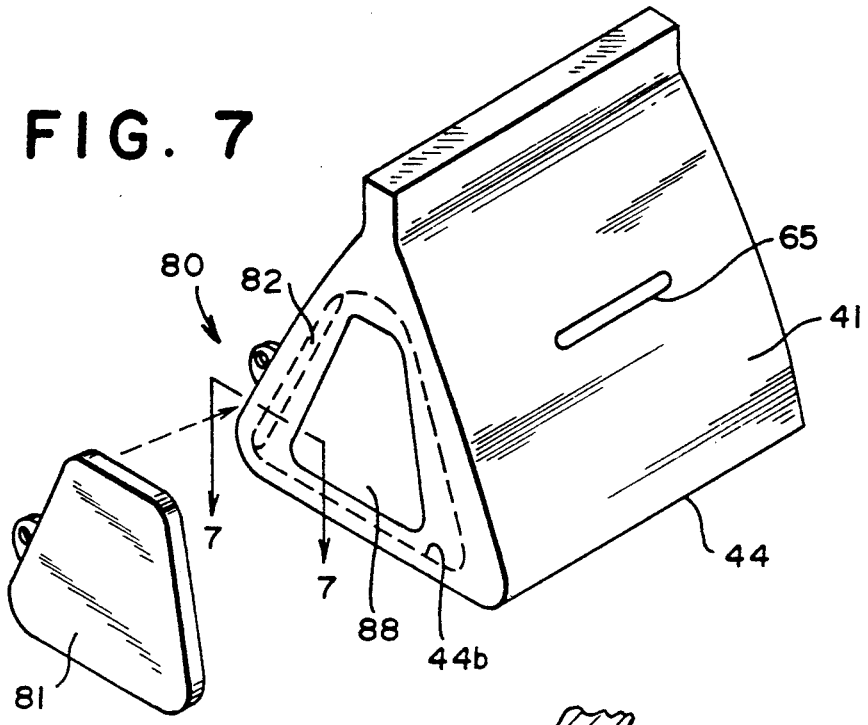
FIG. 8
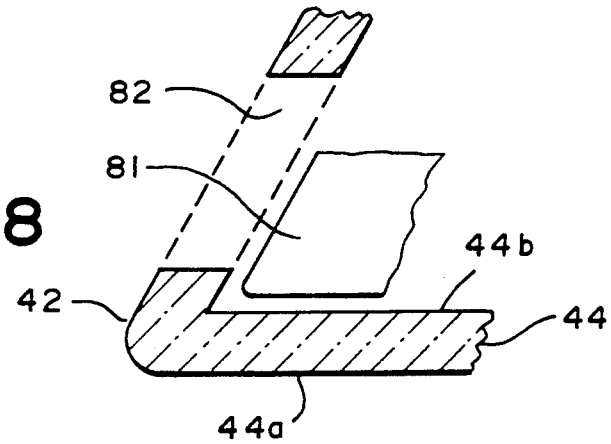
FIG. 9
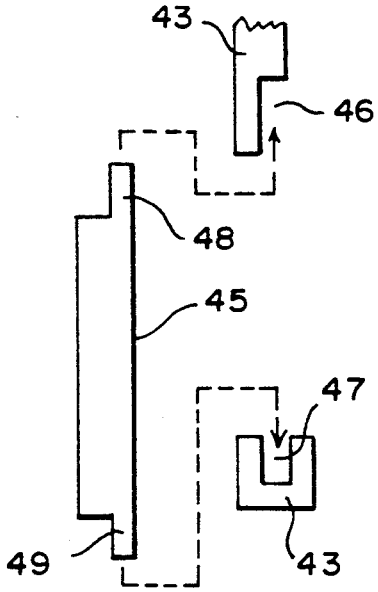
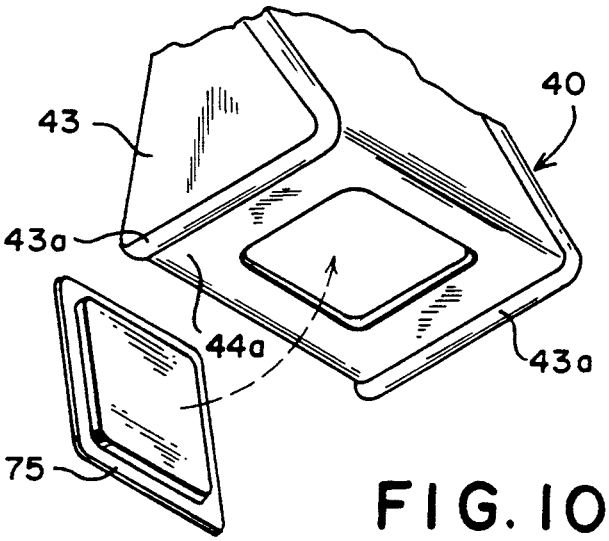
FIG. 10

COIN DROP AMUSEMENT GAME

BACKGROUND OF THE INVENTION

1. Field of the Invention

The present invention relates to an amusement game, more particularly to a game of skill and chance where a coin is dropped through a maze. The object of the game is to get the coin to travel through the maze and come to rest on a pedestal spaced above the coin collection surface at the bottom of the game.

The invention came about in order to stimulate customers to donate their change to worthwhile causes. Typically, fund raising money collection receptacles are placed near the cash register in a retail store, with printed advertising, asking the customer to donate. The typical fund raiser does not encourage any user interaction, while the present invention invites the user to try his skill at getting a coin to rest on the pedestal. This user interaction has been found to create more user participation, which in turn results in increased fund raising.

2. Description of the Background Art

Coin drop amusement games have been around for centuries, as witnessed by U.S. Pat. No. 2,345,781 to Wiedemann and U.S. Pat. No. 2,191,150 to Abell.

The game in the U.S. Pat. No. 2,345,781 reference involves a coin being dropped through the mouth of a fluid-filled bottle, wherein the object of the game is to get the coin to land in a shot glass instead of on the bottom surface.

In the U.S. Pat. No. 2,191,150 reference, a coin is dropped through a slot in the top of a container filled with a liquid, and then the container is manipulated in order to try to balance the coin on top of a post extending upward from the bottom of the container.

The patent to Nicholson (U.S. Pat. No. 1,685,291) is representative of the many amusement devices in which a ball is dropped through a series of pins and randomly comes to rest at one of many designated areas.

Other prior art devices, such as Weitzman (U.S. Pat. No. 3,375,912) and Knaier (U.S. Pat. No. 1,303,211) display a coin traveling through a maze for amusement purposes.

SUMMARY OF THE INVENTION

The present invention relates to an amusement device in the form of a money collection container. The container includes a mouth at one end, a support base at its other end and an elongated body portion therebetween. Disposed within the body portion is a plurality of pins and a coin rest pedestal forming a maze through which a coin on its edge can travel. The pins and pedestal may be permanently fixed within the elongated body portion or on a card which is removably insertable through the mouth into the elongated body portion. In operation, a coin is dropped along the length of the mouth at a location in which the user feels the coin will travel through the maze and come to rest on the pedestal. The pedestal is spaced above the bottom of the base such that if the coin does not land on the pedestal, it will continue to fall and come to rest on a money collection surface in the base. The base optionally includes a door for cleaning out the money, thereby eliminating the need to tip the container over in order to remove the money.

It is an object of the present invention to provide a coin drop game in combination with a maze through which the coin must travel.

Another object of the invention is to provide a user interactive fund raising device, thereby encouraging greater user participation and increased revenues.

Still another object of the invention is to create a revenue generating amusement device which requires minimal counter space.

Yet another object of the invention is to use a fluid in combination with a maze in order to alter the drop path of a coin.

A further object of the invention is to provide a coin drop amusement game with a convenient money clean-out system.

Still another object of the present invention is to provide a maze-type amusement game with replaceable maze boards of varying patterns.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 7 is a perspective view of the base with a sliding door.

FIG. 8 is an exploded sectional view of the sliding door arrangement taken at line 7—7.

FIG. 9 is an illustrative side view showing a side door being connected to a side wall.

FIG. 10 is a bottom view showing another door design.

DESCRIPTION OF THE PREFERRED EMBODIMENTS

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
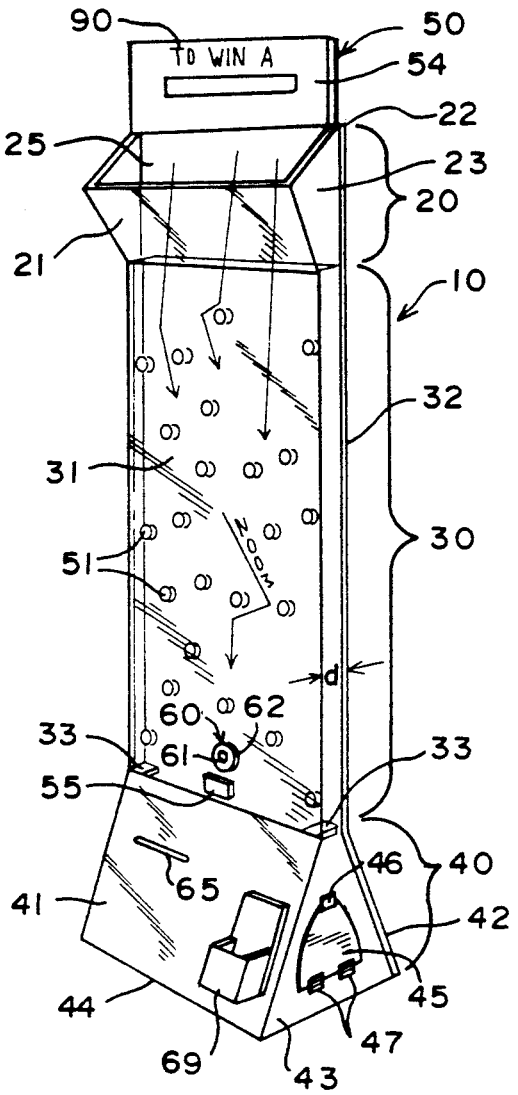
FIG. 1 is a front perspective view of the preferred embodiment.

Turning to FIG. 1, a preferred embodiment of the invention is shown. The amusement device is generally in the form of a receptacle 10, which includes a mouth portion 20, an elongated body portion 30, a base portion 40 and a removable maze card 50.

The mouth portion 20 includes a front wall 21 and a rear wall 22 spaced by angular side walls 23 to form a funnel having a generally rectangular opening 25. The rectangular opening 25 allows for a wide variety of choices as to where one can drop a coin when playing the game.

Figure 2:
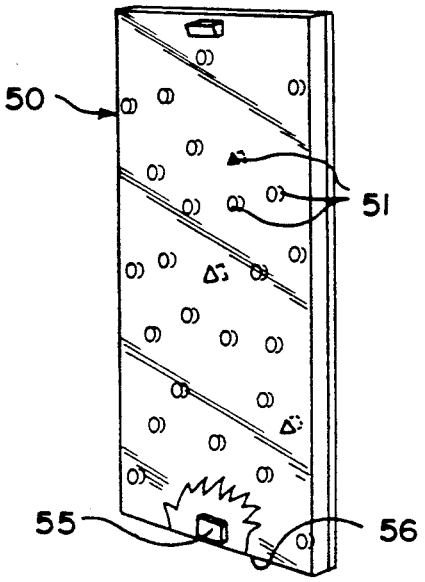
FIG. 2 is a front perspective view of a maze card usable in the preferred embodiment.
Figure 4:
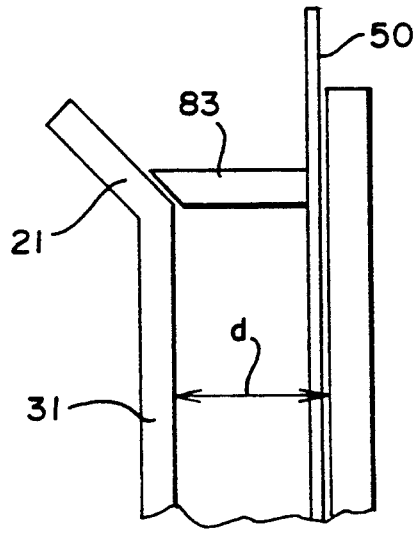
FIG. 4 is an exploded side view of the mouth displaying a card support means.

Elongated body portion 30 includes a front wall 31 spaced from a rear wall 32 a distance d. Distance d is of a length that a coin within the body portion 30 will be maintained in a generally vertical orientation, or in other words, the sides 61 of the coin 60 will be generally parallel to both the front and rear walls 31,32, respectively. The spacing of the front and rear walls by a distance d does not allow the coin to turn on its side 61, and thus only the edges 62 of the coin come into contact with the maze pins 51 during its travel downward. Located at the bottom of the elongated body portion 30 or the top of the base portion 40 are maze card supports 33. As shown, two card supports 33 are used, however, it has been found that one card support is sufficient for supporting a maze card within the elongated body portion 30 Disposed within said body portion 30 is a plurality of pins 51 which may have various geometric configurations as shown in FIG. 2. Also disposed within body portion 30 is a coin rest pedestal 55. In the embodiment shown in FIG. 1, the pins 51 and pedestal 55 are preformed in or on a removable maze card 50. The maze card 50 can be manufactured to have various pin patterns, thereby preventing a user from becoming bored or from becoming too experienced with one pin pattern such that their coin always lands on the coin rest pedestal 55. The maze card 50 is slid within the body portion 30 through opening 25 in the mouth portion 20 until its bottom 56 comes to rest upon card supports 33, or as shown in FIG. 4, the maze card 50 can be formed with an angled card supporting projection 83. The projection 83 mates with the angled front wall 21 to suspend the maze card.

The maze card 50 can be transparent or opaque and includes printed indicia 90 thereon, for example, instructions encouraging one to play, direction arrows, graphic displays, and/or advertisements are some of the many types of indicia possible.

As can be seen in FIG. 1, the card may have an upper section 54 which extends out through mouth portion 20 in order to aid in the insertion and removal of maze card 50. The maze card 50 shown in FIG. 2 does not include upper section 54, and thus removal is by means of a tool or turning the game over to allow gravity to take effect.

Figure 3:
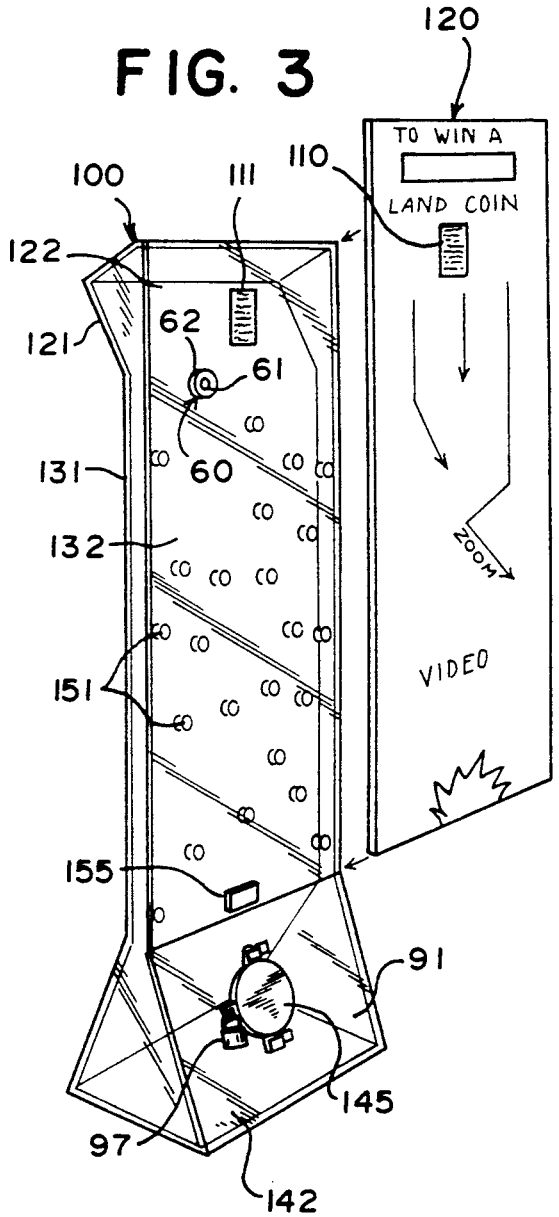
FIG. 3 is a rear perspective view of a second embodiment.
Figure 5:
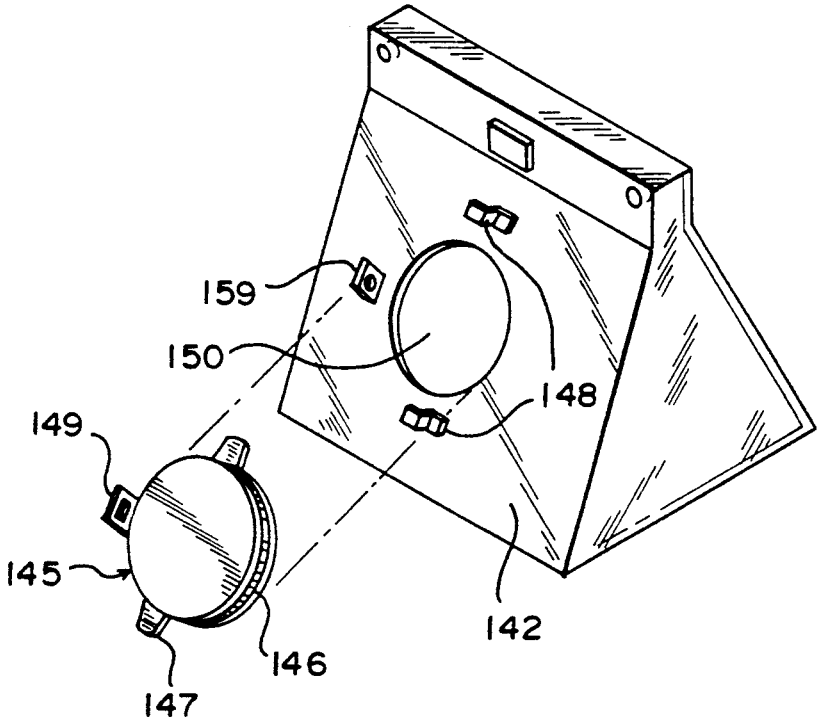
FIG. 5 is an exploded view of the base with a watertight door.

In the embodiment displayed in FIG. 3, the pins 151 and pedestal 155 are secured between and to the front and rear walls 131,132, respectively. Since the pins 151 and the pedestal 155 are permanently secured, the coin's path of travel can be learned after numerous drops. However, this embodiment has been designed so as to be watertight, which thereby allows fluid 91 of varying viscosities to be added within the maze to alter a coin's path of travel. Turning to FIG. 5, a door 145 as depicted in FIG. 3 includes an 0-ring 146 which provides a watertight seal between door 145 and base rear wall 142. Door 145 further includes extensions 147, which abut and are held under angled locking tabs 148 when door 145 is inserted into opening 150 and twisted to align tabs 159 on rear wall 142 and tab 149 on door 145. This twist and lock arrangement is sufficient to withstand any fluid pressure created within the receptacle 100. Tabs 159 and 149 include an aperture therethrough in order to allow the insertion of a padlock 97, which prevents the unauthorized removal of money. Further shown in the embodiment of FIG. 3 is a display card 120 with printed matter thereon. Display card 120 is secured to rear walls 122 and 132 by any suitable fastener system such as hook 110 and loop 111 type fasteners. When installed, the printed matter is visible through the transparent front walls of the device.

Base portion 40 can come in various shapes as long as the base design is such that the elongated body portion 30 and mouth portion 20 can be supported in an upright manner. Base portion 40 includes a front wall 41, a rear wall 42, side walls 43 and a bottom wall 44. The bottom wall having an exterior support surface **44*a* and an interior money collection surface 44*b*. The bottom 43*a* of side walls 43 may also be used as a support surface for the entire receptacle 10, as shown in FIG. 10**.

Referring again to FIG. 1, the base 40 is shown with a money slot 65 cut into the front wall 41 and a pamphlet holder 69 attachable to either the front wall 41, rear wall 42, or side walls 43 of the receptacle 10.

Figure 6:
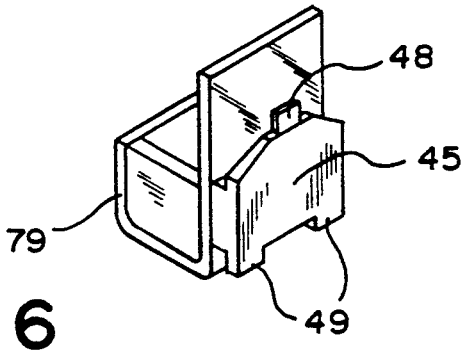
FIG. 6 is a rear perspective view of a side door in combination with a pamphlet holder.

One of the side walls 43 has a door 45 with an upper arm 48 which hinges in at a top notch 46 and then slides vertically down such that lower arms 49 slide into grooves 47. Note sectional side view displayed in FIG. 9. Also, in another option as shown in FIG. 6, door 45 can be coupled with a pamphlet holder 79, thereby combining elements in order to limit the number of parts.

FIGS. 7 and 8 show a sliding door arrangement 80 wherein door 81 slides into a slot 82 in the rear wall 42, as indicated by the broken arrows. The slot 82 is cut in rear wall 42 above the interior money collection surface **44*b* such that when door 81 is fully inserted through slot 82, door 81 drops down to rest upon surface 44*b* adjacent opening 88 in side wall 43. FIG. 8 better illustrates the corner of the fully inserted door 81 which is dropped down to rest upon interior coin collection surface 44*b***.

FIG. 10 shows a bottom view of the base portion 40 having a removable bottom door 75. Also shown in FIG. 10 is the extension of side walls 43 past the exterior base bottom **44*a* such that bottoms 43*a* of the side walls 43 form a support stand for receptacle 10**.

The preferred material from which the amusement device is to be manufactured is a transparent plastic. However, various other materials, such as metal or wood, could be used as long as the elongated body portion is made from a transparent material.

In operation of the preferred embodiment, a maze card 50 is inserted into the elongated body portion 30 such that the pins 51 and pedestal 55 are disposed therein. The user then takes a coin 60 and drops it anywhere along the length of the mouth 20 at a position which the user feels will result in the coin 60 traveling through the maze, bouncing off pins 51 and coming to rest on pedestal 55 instead of traveling past pedestal 55 down to the money collection surface **44*b*. If the coin is strategically dropped such that it lands and rests upon pedestal 55, the user wins the game and may be awarded a prize from the retailer upon whose countertop the game is located. Operation of the embodiment shown in FIG. 3 is similar, except that a maze card need not be inserted, but rather the receptacle 100 is optionally filled with a liquid 91 and display card 120** attached before a coin is dropped.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. An amusement device of chance in the form of a receptacle comprising:

a) a mouth portion through which a coin may be dropped;

b) a central body portion extending downward from said mouth portion having a maze of pins and a coin rest pedestal disposed therein;

c) a base supporting the central body and mouth portions thereabove such that the coin rest pedestal is spaced above the bottom interior surface of the base; and, d) wherein in use, a coin dropped anywhere along the mouth will come to rest either on the pedestal or continue travelling on to the bottom interior surface of the base.

2. The invention of claim wherein said central body portion is elongated and includes a front wall and a back wall spaced by side walls at a distance which maintains the sides of a coin in a generally vertical orientation.

3. The invention of claim 2 wherein said pins are secured to and between said front and back walls.

4. The invention of claim 1 wherein the maze of pins and coin rest pedestal are located on a card which is removably insertable into said central body portion.

5. The invention of claim 4 further including a plurality of cards with various maze patterns.

6. The invention of claim 4 wherein said cards include printed indicia thereon.

7. The invention of claim 1 wherein said mouth includes a front wall spaced from a back wall by angular side walls, thereby functioning as a funnel for dropped coins.

8. The invention of claim 1 wherein said pins may have various geometric configurations.

9. The invention of claim wherein said base includes spaced front and back walls, opposed side walls and a bottom wall which together form a money collection box.

10. The invention of claim 9 wherein one of said base walls includes a slot for receiving money in the form of paper or coin.

11. The invention of claim 9 wherein said base includes a door to allow entry into the base in order to clean out the collected money.

12. The invention of claim 11 wherein said base includes a door to allow entry into the base in order to clean out the collected money.

13. The invention of claim 11 wherein said door includes a watertight seal, and the receptacle formed by the central body portion and base is watertight.

14. The invention of claim 11 wherein said door includes means for locking it to said base.

15. The invention of claim 11 wherein said door is in direct cooperation with a literature holding display.

16. The invention of claim 1 further including a literature holding display attached to said base.

17. The invention of claim 1 wherein said base includes a side wall with an opening therein, a rear wall with a slot therein and a door which slides into said slot and then drops down to lock into place adjacent said opening.

18. An amusement device comprising:

a receptacle having a first end with an open mouth, a closed base at a second, opposite end and a central body therebetween;

said central body portion having a front wall spaced from a rear wall;

a card removably disposed within said central body having a plurality of pins forming a maze through which a coin can travel and a coin rest pedestal; and, wherein said pins and pedestal extend between said front and rear walls.

19. The invention of claim 18 wherein said central body is elongated and the front and back wall are spaced at a distance which maintains the sides of a coin in a generally vertical orientation.

20. The invention of claim 18 wherein said base includes spaced front and back walls, opposed side walls and a bottom wall which together form a money collection box.

* * * * *